US011084617B2

(12) United States Patent
Herrmann

(10) Patent No.: US 11,084,617 B2
(45) Date of Patent: Aug. 10, 2021

(54) LABEL APPLICATION WITH RELEASE LINER DISPOSAL

(71) Applicant: Xerox Corporation, Norwalk, CT (US)

(72) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/367,988

(22) Filed: Mar. 28, 2019

(65) Prior Publication Data

US 2020/0307848 A1 Oct. 1, 2020

(51) Int. Cl.

| | |
|---|---|
| ***B65C 1/02*** | (2006.01) |
| ***B65C 9/00*** | (2006.01) |
| ***B65C 9/40*** | (2006.01) |
| ***B65C 9/46*** | (2006.01) |

(52) U.S. Cl.

CPC ..... *B65C 1/028* (2013.01); *B65C 9/0006* (2013.01); *B65C 9/40* (2013.01); *B65C 9/46* (2013.01); *B65C 2009/0009* (2013.01); *B65C 2009/0087* (2013.01); *B65C 2009/408* (2013.01)

(58) Field of Classification Search

CPC . B65C 1/021; B65C 1/028; B65C 2009/0009; B65C 2009/0021; B65C 2009/0087; B65C 2009/404; B65C 2009/408; B65C 9/0006; B65C 9/40; B65C 9/46

See application file for complete search history.

(56) References Cited

U.S. PATENT DOCUMENTS

| | | | | |
|---|---|---|---|---|
| 3,774,489 | A * | 11/1973 | Kercher | B26D 7/015 83/423 |
| 4,041,863 | A * | 8/1977 | Mullen | B41K 5/026 101/269 |
| 4,260,656 | A * | 4/1981 | Mullen | B31D 1/02 156/253 |
| 4,288,272 | A * | 9/1981 | Pfeffer | B65C 9/1869 156/361 |
| 4,597,815 | A * | 7/1986 | Nakamura | B44C 1/1716 156/234 |
| 4,624,734 | A | 11/1986 | Voltmer et al. | |
| 4,927,486 | A | 5/1990 | Fattal et al. | |

(Continued)

FOREIGN PATENT DOCUMENTS

| | | | |
|---|---|---|---|
| CN | 203950325 | U | 11/2014 |
| ES | 2631138 | B1 | 8/2017 |
| JP | 200676587 | A | 3/2006 |

*Primary Examiner* — Sonya M Sengupta

(74) *Attorney, Agent, or Firm* — Gibb & Riley, LLC

(57) ABSTRACT

A printer prints label data on a self-adhesive label that has a tabbed backing to produce a printed label on the tabbed backing. Also, a label feeder is positioned relative to the printer to transport the printed label on the tabbed backing away from the printer. A label applicator is positioned, relative to the feeder, to remove the printed label on the tabbed backing from the feeder. The tabbed backing includes a first section, covering an adhesive area of the printed label, and a tab extending from the first section. The label applicator includes a holder, that is shaped to grasp the tab of the tabbed backing, and a moveable element that is configured to remove the printed label from the tabbed backing and affix the adhesive area of the printed label to an item.

20 Claims, 11 Drawing Sheets

(56) References Cited

U.S. PATENT DOCUMENTS

| | | | | | |
|---|---|---|---|---|---|
| 5,061,334 | A | * | 10/1991 | Paules | B65C 9/226<br>156/235 |
| 5,261,563 | A | * | 11/1993 | Brimhall | B65C 11/00<br>221/71 |
| 5,547,227 | A | | 8/1996 | Laurash et al. | |
| 5,705,245 | A | * | 1/1998 | Loemker | B32B 3/02<br>428/42.3 |
| 5,902,449 | A | | 5/1999 | Moore | |
| 6,067,103 | A | | 5/2000 | Ewert et al. | |
| 6,284,338 | B1 | | 9/2001 | Bauman et al. | |
| 6,352,094 | B1 | | 3/2002 | Gunderson et al. | |
| 9,361,811 | B2 | | 6/2016 | Shanley et al. | |
| 9,959,788 | B2 | | 5/2018 | Shanley et al. | |
| 2006/0144521 | A1 | | 7/2006 | Esposito et al. | |
| 2009/0126866 | A1 | | 5/2009 | Stenner et al. | |

* cited by examiner

LABEL APPLICATION WITH RELEASE LINER DISPOSAL

BACKGROUND

Systems and methods herein generally relate to devices and methods that apply labels.

Variable information printing allows each printed item to be different (customized) and this is highly useful for many operations, including e-commerce sellers who ship a small number of different items to each of a large number of different people at different addresses. Large e-commerce sellers use automated equipment to package sold goods and print self-adhesive address labels for the delivery of such packages. However, often the self-adhesive address labels are applied manually, which can slow output and increased labor costs.

For small quantities, manual removal of the release liner (label backing) and application of the label to the package is not disruptive; however, as the quantities increase, this task becomes difficult to handle.

SUMMARY

Various devices and systems herein include, among other components, a controller that is configured to receive label data; and a printer, in communication with the controller, that is controlled by the controller to print at least a first portion (e.g., name and address, barcodes, tracking numbers, etc.) of the item data on the frontside of a self-adhesive label (the self-adhesive label has a tabbed backing or release liner) to produce a printed label on the tabbed backing. Also, a label feeder is positioned relative to the printer to transport the printed label on the tabbed backing away from the printer.

These devices and systems also include a label applicator that is positioned, relative to the label feeder, to remove the printed label on the tabbed backing from the label feeder. Further, an item feeder is configured to transport an item (that is to receive the printed label) to the label applicator.

These devices/systems can also include a detector, that is in communication with the controller, and that is positioned adjacent to the item feeder. The detector is in a location to detect (e.g., optically, wirelessly, through contact sensors, etc.) "item data" from the item while the item is on the item feeder and before the item is transported to the label applicator. Portions of the item data used to print the label data can be sent to the printer (or the label data can come from another source, such as a remote server). The controller is also configured to compare a second portion of the label data (e.g., data that associates the printed label with the item, the contents therein, etc.) with the item data to determine if the printed label that is ready to be affixed corresponds to the item to which the printed label is to be affixed. Also, these devices/systems may include a sorter, that is controlled by the controller, and that is positioned adjacent to the item feeder. The sorter is in a location to remove the item from the item feeder, based on a corresponding printed label not matching a corresponding item.

The tabbed backing includes a first section, covering an adhesive area of the backside of the printed label, and at least one tab extending from the first section (e.g., the tab extends beyond the edge of the printed label in a direction perpendicular to the edge of the printed label).

The label applicator includes a holder, that is shaped to grasp the tab of the tabbed backing, and a moveable element (e.g., articulated arm, etc.) that is configured to remove the printed label from the tabbed backing. The moveable element is thus configured to move to affix the adhesive area of the printed label to a corresponding item after removing the printed label from the tabbed backing (again, based on (when/if) the printed label corresponding to the item).

In greater detail, the moveable element is configured to first move the printed label (while still on the tabbed backing) from the label feeder to the holder to allow the holder to grasp the tab, and then move the printed label away from the tabbed backing, while the tab is still being grasped by the holder, to remove the printed label from the tabbed backing.

More specifically, the moveable element can include an "articulated member" (e.g., computer-controlled robotic arm, driven slide on beam, extendable arm, articulated actuated multi-axis beams, etc.) and a "contact element" that is connected to the articulated member. The contact element is configured to grasp the frontside of the printed label. For example, the contact element can have a grasping device (e.g., a vacuum pad, an electrically charged surface, a releasable adhesive pad, a clamp, etc.) that temporarily grasps the frontside of the printed label. This grasping device of the contact element can have, for example, a size that is approximately equal to the size of the frontside of the printed label.

Also, a holder transport can be connected to the holder of the label applicator. The holder transport is configured to move the holder to a waste receptacle after the moveable element/contact element have removed the printed label from the tabbed backing. When in position adjacent to the waste receptacle, the holder is configured to release the tabbed backing so as to deposit the tabbed backing in the waste receptacle.

Correspondingly, exemplary methods herein detect item data of the item, before the item reaches the label applicator, using the detector that is connected to the processor. Such methods supply (by the processor) the label data of the item data to the printer and print (using the printer) the label data on the self-adhesive label that has the tabbed backing, to produce the printed label on the tabbed backing.

Also, such methods move (using the label feeder) the printed label on the tabbed backing from the printer to the label applicator and move (using the item feeder) the item to the label applicator.

Such methods can compare (using the processor) the label data with the item data to determine if the printed label corresponds to the item. After performing such a comparison, these methods can: remove (using the sorter that is controlled by the controller) the item from the item feeder before the item reaches the label applicator, based on the printed label not corresponding to the item; or remove (using the label applicator 130) the printed label from the label feeder before the printed label reaches the label applicator, based on the printed label not corresponding to the item.

If neither the item nor the printed label are removed, these methods position (using the label applicator) the tab within the holder, grasp (using the holder of the label applicator) the tab of the tabbed backing, remove (using the movable element/contact element of the label applicator) the printed label from the tabbed backing, and affix (using the movable element) the printed label to the item. Thus, these methods control the label feeder and the item feeder to position the corresponding item adjacent the label applicator after the movable element has removed the printed label from the tabbed backing. Further, such methods move (using the holder transport that is connected to the holder) the holder to a waste receptacle after the moveable element has removed the printed label from the tabbed backing. This allows these methods to deposit (using the holder) the tabbed backing in the waste receptacle.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, often self-adhesive address labels are applied manually; and while this is not disruptive for small quantities, as the quantities increase this task can slow output and increased labor costs. Therefore, the systems and methods herein provide a fully automated solution capable of removing self-adhesive labels from their release layer (backing) and placing such labels on packages to provide a consistent, fast automated solution.

With systems and methods herein, the contents within a package (and appropriate shipping information) are sometimes identified using a bar code, RFID, OCR or other identifier and a corresponding label is printed. The printing of the label can be triggered by the arrival of a package. These systems include components for rejecting a package or label if either the package contents and/or the label do not match, or if there is a quality problem with either item.

A moveable element acquires the label, removes the release liner (backing), transports the adhesive label to the package, and affixes the label to the package. More specifically, the systems herein include a clamping and translating system that works in conjunction with a robotic pick and place system. The robotic arm acquires a potentially folded label from the printer output, and the robot moves the label with release tabs exposed to the clamping and translating release liner removal system. The clamps hold the release tabs as the label is presented by the robotic arm. Once the clamps have securely locked onto the release liner tabs, the robotic arm then moves vertically to move the label away from the clamped release liner. The release liner is then shuttled to a disposal area as the label (free of release liner) is moved to the outgoing package where it is affixed for shipment.

Therefore, the systems and methods herein provide fully automated label printing, removal of the release liner, disposal of the release liner, and application of the label to the correct box; and this eliminates the need for manual application of self-adhesive address labels, reducing the potential slow output and increased labor costs associated with this task.

Figure 1:
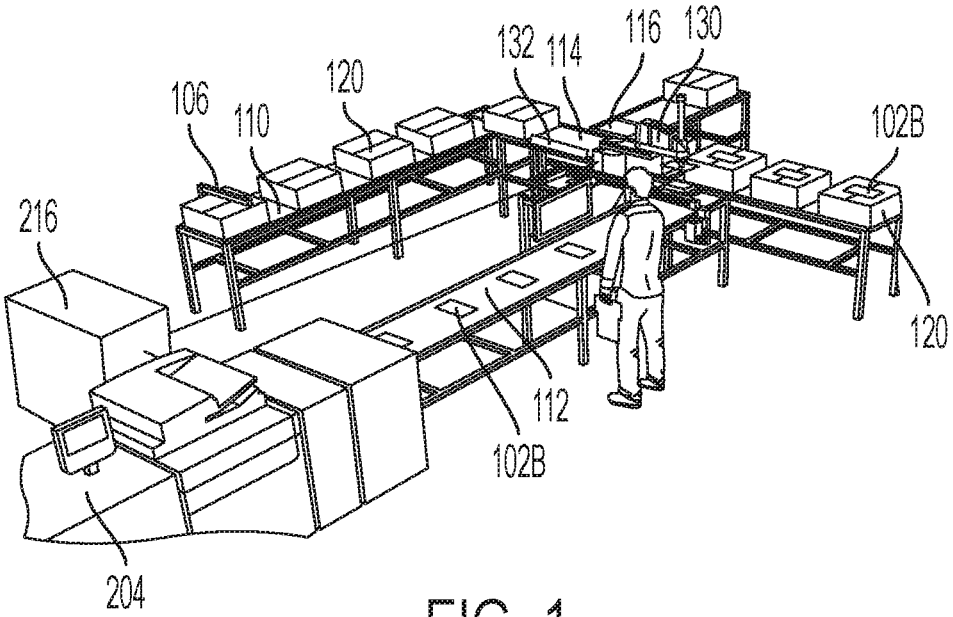
FIGS. 1-2 are perspective conceptual schematic diagrams illustrating different views of systems herein.
Figure 2:
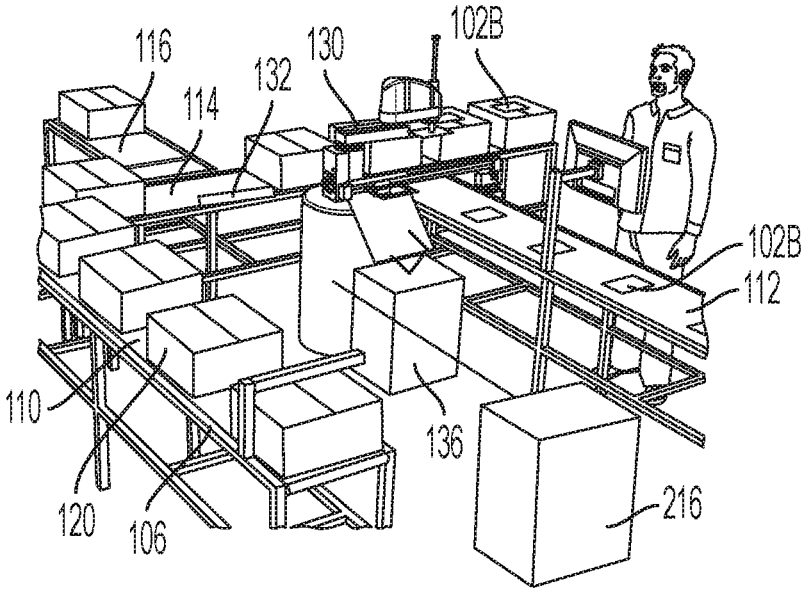

Referring now to the accompanying drawings, FIGS. 1-2 are perspective conceptual schematic diagrams illustrating different views of systems herein, and FIGS. 3-6 are similarly perspective conceptual schematic diagrams of some components shown in FIGS. 1-2 in greater detail. As can be seen in FIGS. 1-6, various devices and systems herein include, among other components, a controller 216 that is configured to receive label data and/or item data; and a printer 204, in communication with the controller 216, that is controlled by the controller 216 to print at least a first portion (e.g., "label data" including, for example, name and address, barcodes, tracking numbers, etc.) of the item data on a self-adhesive label (the self-adhesive label has a tabbed backing) to produce at least one printed label 102B on the tabbed backing.

Also, a label feeder 112 is positioned relative to the printer 204 to transport the printed label 102B on the tabbed backing away from the printer 204. Further, an item feeder (s) 110, 114 is configured to transport at least one item 120 (that is to receive the printed label 102) to the label applicator 130.

These devices/systems can also include an item detector 106, that is in communication with the controller 216, and that is positioned adjacent to the item feeder(s) 110, 114. The item detector 106 is in a location to detect (e.g., optically, wirelessly, through contact sensors, etc.) "item data" from the item 120 while the item 120 is on the item feeder(s) 110, 114 and before the item 120 is transported to the label applicator 130.

The controller 216 is configured to compare a portion of the label data (e.g., data that associates the printed label 102B with the item 120, etc.) with the item data to determine if the printed label 102B that is ready to be affixed corresponds to the item 120 to which the printed label 102B is in order to be affixed. Also, these devices/systems may include a sorter 132, that is controlled by the controller 216, and that is positioned adjacent to the item feeder(s) 110, 114. The sorter 132 is in a location to redirect the item 120 from the item feeder(s) 110, 114, on to a third feeder 116 based on the printed label 102B not corresponding to the item 120. Any such sorted items 120 on the third feeder 116 can be inspected for defects, returned to the item feeder(s) 110, 114, etc., manually or automatically.

As shown in FIGS. 1 and 2, the label applicator 130 is positioned, relative to the first and item feeders 110-114, to remove the printed label 102B on the tabbed backing from the label feeder 112, remove the tabbed backing from the printed label 102B, and affix the printed label 102B to the item 120.

Figure 3:
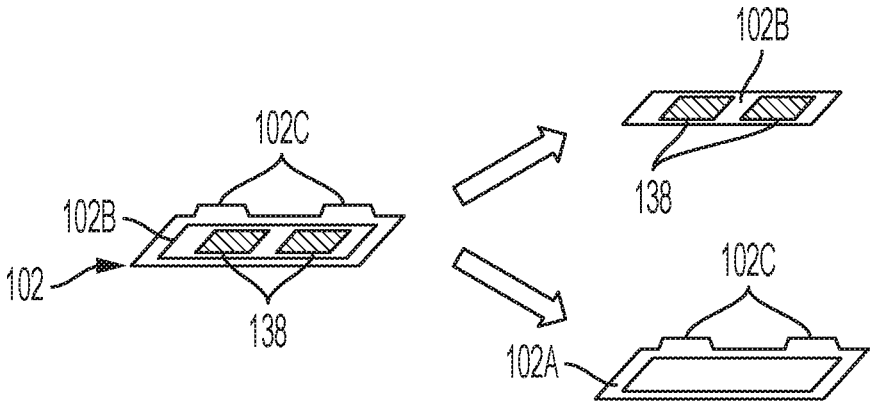
FIGS. 3-5 are perspective conceptual schematic diagrams of components shown in FIGS. 1-2 in greater detail.

As shown in FIG. 3, the label 102 includes a self-adhesive sheet portion 102B, the frontside of which receives printed label data 138 from the printer 204, and a backing material portion (release layer) 102A, 102C. The self-adhesive sheet portion 102B is sometimes referred to herein simply as a printed label 102B, and the printed label 102B has the frontside that readily accepts, and permanently keeps, printed markings; and an opposite side (backside), portions or all of which is coated with an adhesive. The printed label 102B can be a single sheet of material or can be a pouch or other complex sealed document holder that may be, for example, folded/sealed by the printer 204 before being output.

As shown in FIG. 3, the backing material 102A, 102C includes a backing section 102A, contacting and covering the adhesive area(s) of the backside of the printed label 102B. The backing section 102A includes a low-adhesion surface that is easily removable from the adhesive area(s) of the backside of the printed label 102B, and that prevents the self-adhesive label 102B from sticking to other items prematurely. At least one (e.g. 1, 2, 3, 4, etc.) tab 102C extends from the backing section 102A (e.g., the tab 102C extends beyond the edge of the backing section 102A and the self-adhesive label 102B in a direction generally perpendicular to the edge of the self-adhesive label 102B).

Figure 4:
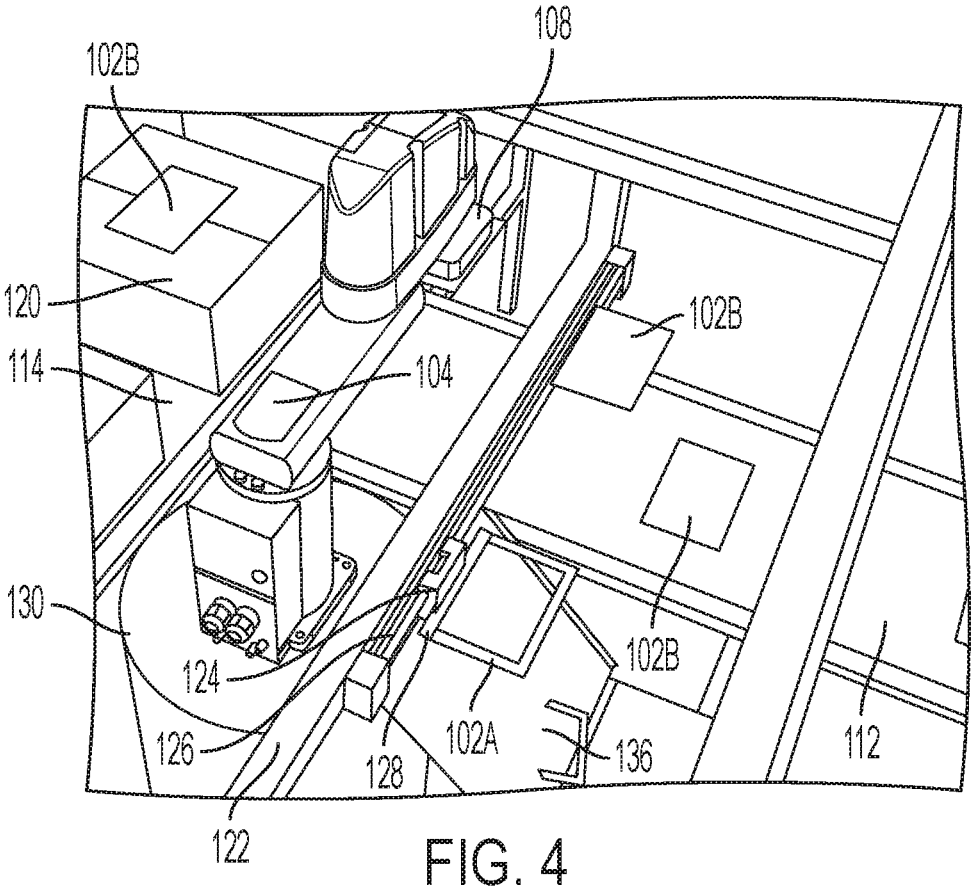

As shown in FIG. 4, the label applicator 130 includes a group of components that are referred to herein as a label removal device 122, and a moveable element 104 (e.g., articulated arm, etc.). The moveable element 104 can be a device that automatically moves in many axis (e.g., computer-controlled robotic arm, driven slide on beam, extendable arm, articulated actuated beams, etc.) and can include a contact element 108 that is connected to the distal end of the articulated member 104.

The contact element 108 is configured to grasp only the printed label 102B without grasping the tabbed backing material 102A, 102C. For example, the contact element 108 can have a grasping device (e.g., a vacuum pad, an electrically charged surface, a releasable adhesive pad, a clamp, etc.) that temporarily grasps the printed label 102B (for example, contact element 108 only contacts the frontside of the printed label 102B). This grasping device of the contact element 108 generally can, for example, have a size that is approximately equal to (e.g., within 80%, 60%, 50% etc.) the size of the printed label 102B.

Figure 5:
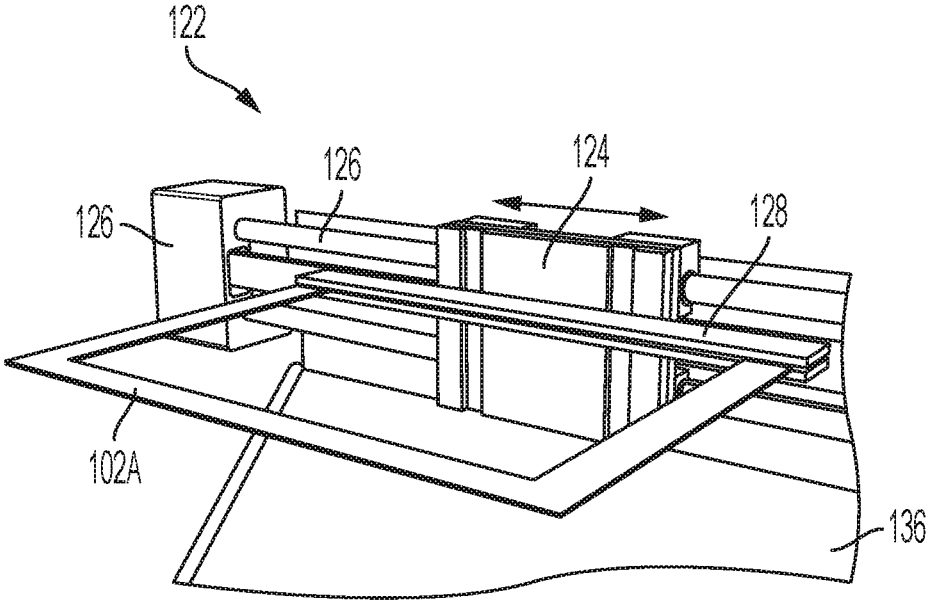

The label removal device 122 is shown in greater detail in FIG. 5. As shown in FIGS. 4 and 5, the label removal device 122 includes a holder (e.g., clamp, claw, etc.) 128, that is shaped to grasp the only the tab(s) 102C of the tabbed backing 102A (without grasping any part of the printed label 102B) and that is configured to assist in the removal of the printed label 102B from the tabbed backing 102A.

As shown in FIGS. 4 and 5, a holder transport 124 can be connected to the holder 128. The holder transport 124 is configured to move the holder 128 along a powered rail system 126 or other similar translation (linear movement) device, to a waste receptacle 136 after the moveable element 104 has removed the printed label 102B from the tabbed backing 102A. When in position adjacent to the waste receptacle 136, the holder 128 is configured to release the tabbed backing material 102A so as to deposit the tabbed backing 102A in the waste receptacle 136. Again, the moveable element 104 is configured to affix the adhesive area of only the printed label 102B to the appropriate item 120 after removing the printed label 102B from the tabbed backing 102A (based on the printed label 102B corresponding to the item 120).

Figure 6A:
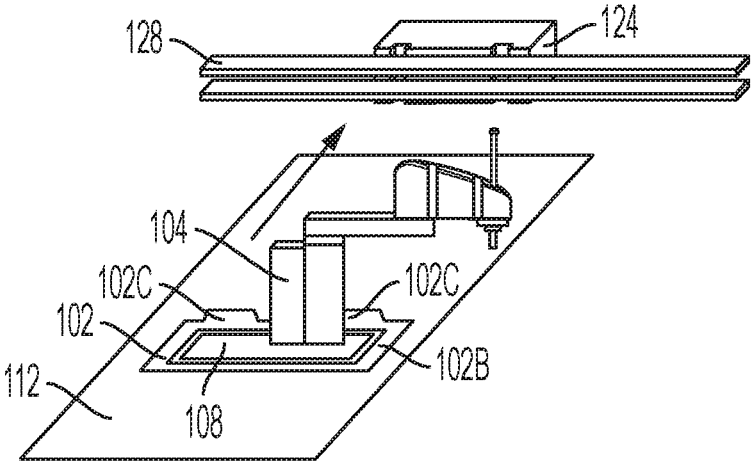
FIGS. 6A-6H are perspective conceptual schematic diagrams illustrating operations of systems herein.
Figure 6B:
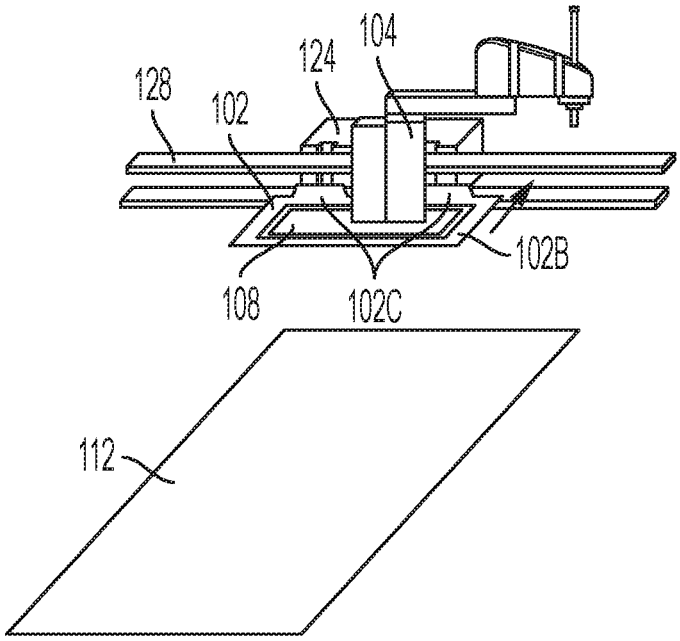
Figure 6C:
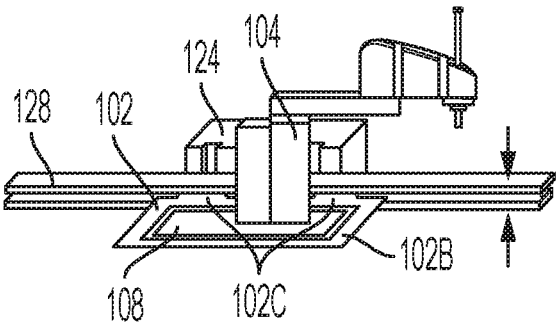

FIGS. 6A-6G show various phases of these operations. For example, FIG. 6A shows that the moveable element 104 is configured to first grasp and move the printed label 102B (while the printed label 102B is still on the tabbed backing 102A) from the label feeder 112 to the holder 128, to allow the holder 128 to grasp the tab(s) 102C. As shown in FIG. 6B, as part of this movement, the movable element 104 moves into a position so that the tab(s) 102C are inserted between grasping elements of the holder 128. FIG. 6C shows that the grasping elements of the holder 128 come together to pitch or otherwise hold (clamp, as shown by the opposing arrows directed toward one another) only the tab(s) 102C without grasping the portion of the label 102B that is to be removed from the tabbed backing 102A.

Figure 6D:
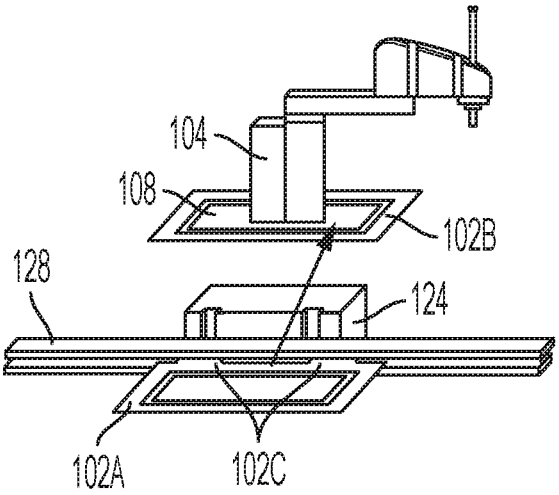

FIG. 6D shows that the movable element 104 moves away from the holder 128 to move only the printed label 102B away from the tabbed backing 102A, while the tab(s) 102C are still being grasped by the holder 128, to remove the printed label 102B from the tabbed backing 102A.

Figure 6E:
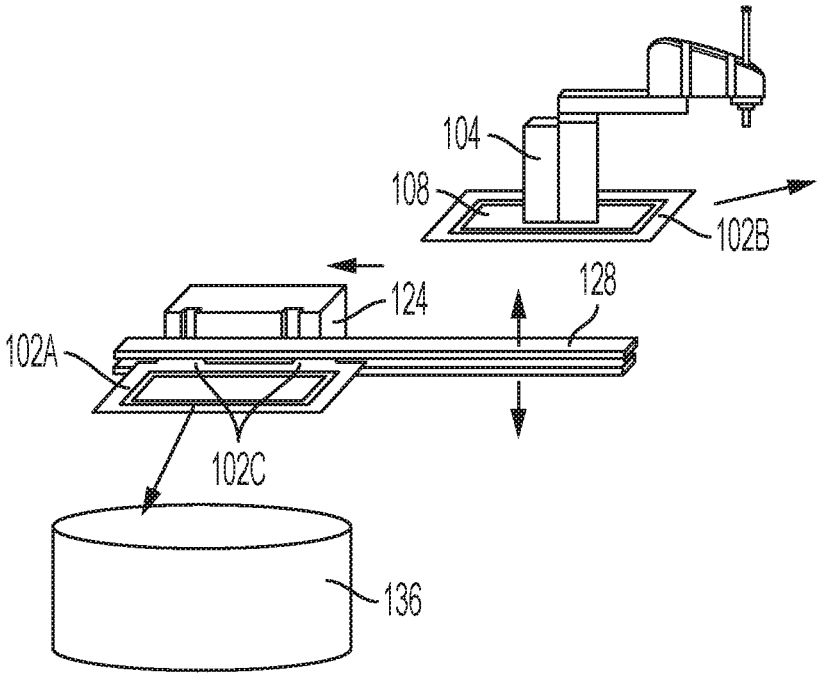

FIG. 6E shows that the holder 128 moves along the translation device (e.g., 126 shown in FIGS. 4 and 5) to the waste receptacle 136 after the moveable element 104 has removed the printed label 102B from the tabbed backing 102A. FIG. 6E also shows that, when in position adjacent to the waste receptacle 136, the holder 128 releases (unclamp, as shown by the opposing arrows directed away from one another) the tabbed backing material 102A so as to deposit the tabbed backing 102A in the waste receptacle 136.

Figure 6F:
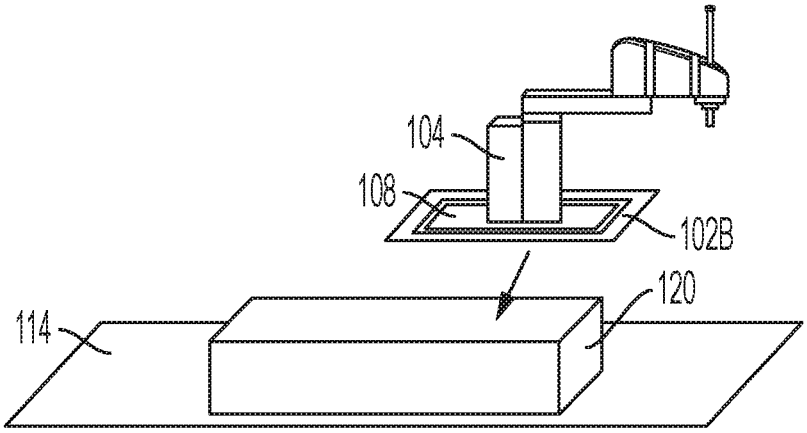
Figure 6G:
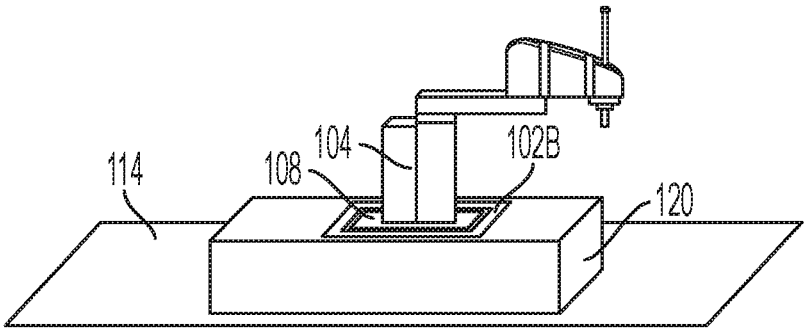
Figure 6H:
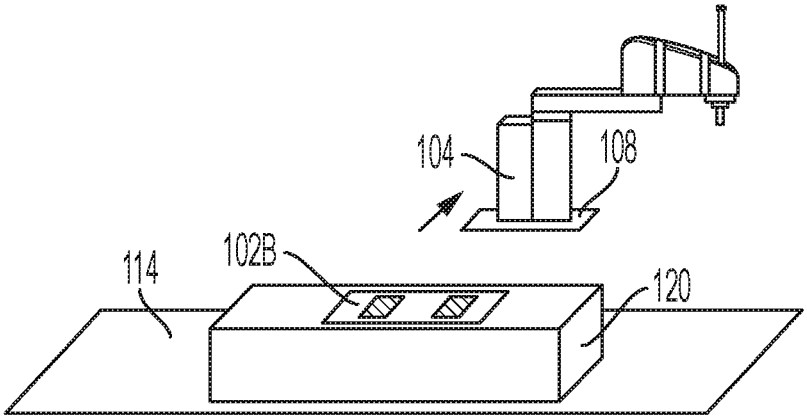

FIG. 6F, shows that the moveable element 104 is configured to move the contact element 108 and the printed label 102B toward the corresponding item 120 that is to receive the printed label 102B after removing the printed label 102B from the tabbed backing 102A. As shown in FIG. 6G, the moveable element 104 presses the printed label 102B against the exterior of the item 120 to cause the adhesive on one side of printed label 102B to bind the printed label 102B to the exterior of the item 120 and thereby affix the adhesive area of only the printed label 102B to the item 120. FIG. 6H illustrates that the movable element 104 returns to the label feeder 112 to obtain the next printed label 102B after affixing the printed label 102B on the item 120.

Figure 7:
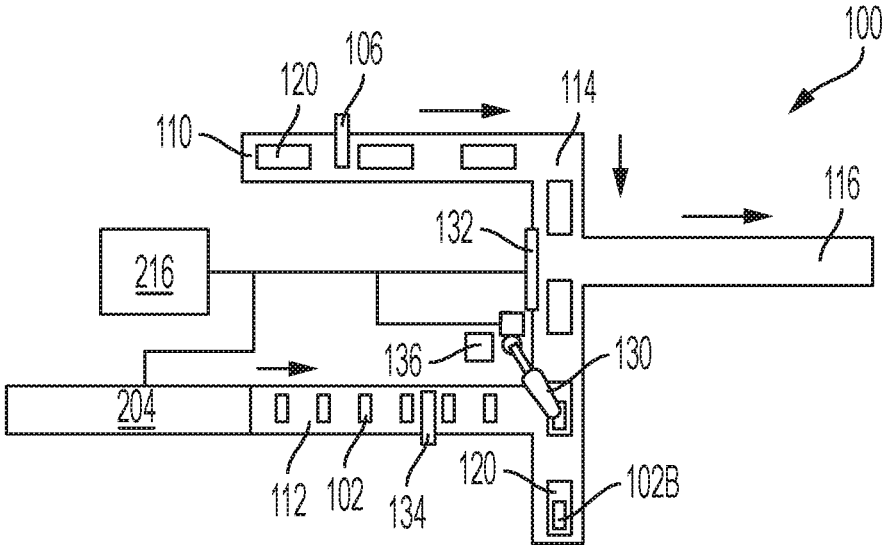
FIGS. 7-8 are plan-view conceptual schematic diagrams illustrating operations of systems herein.
Figure 8:
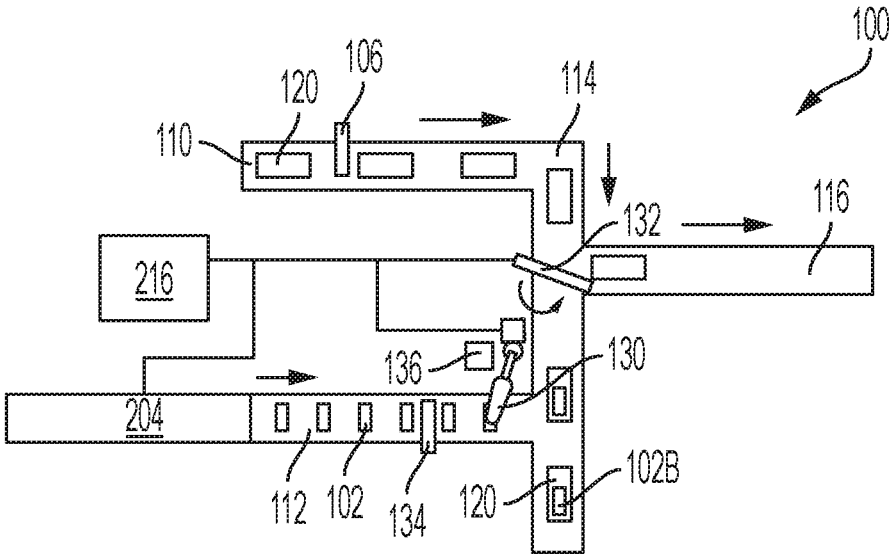
Figure 9:
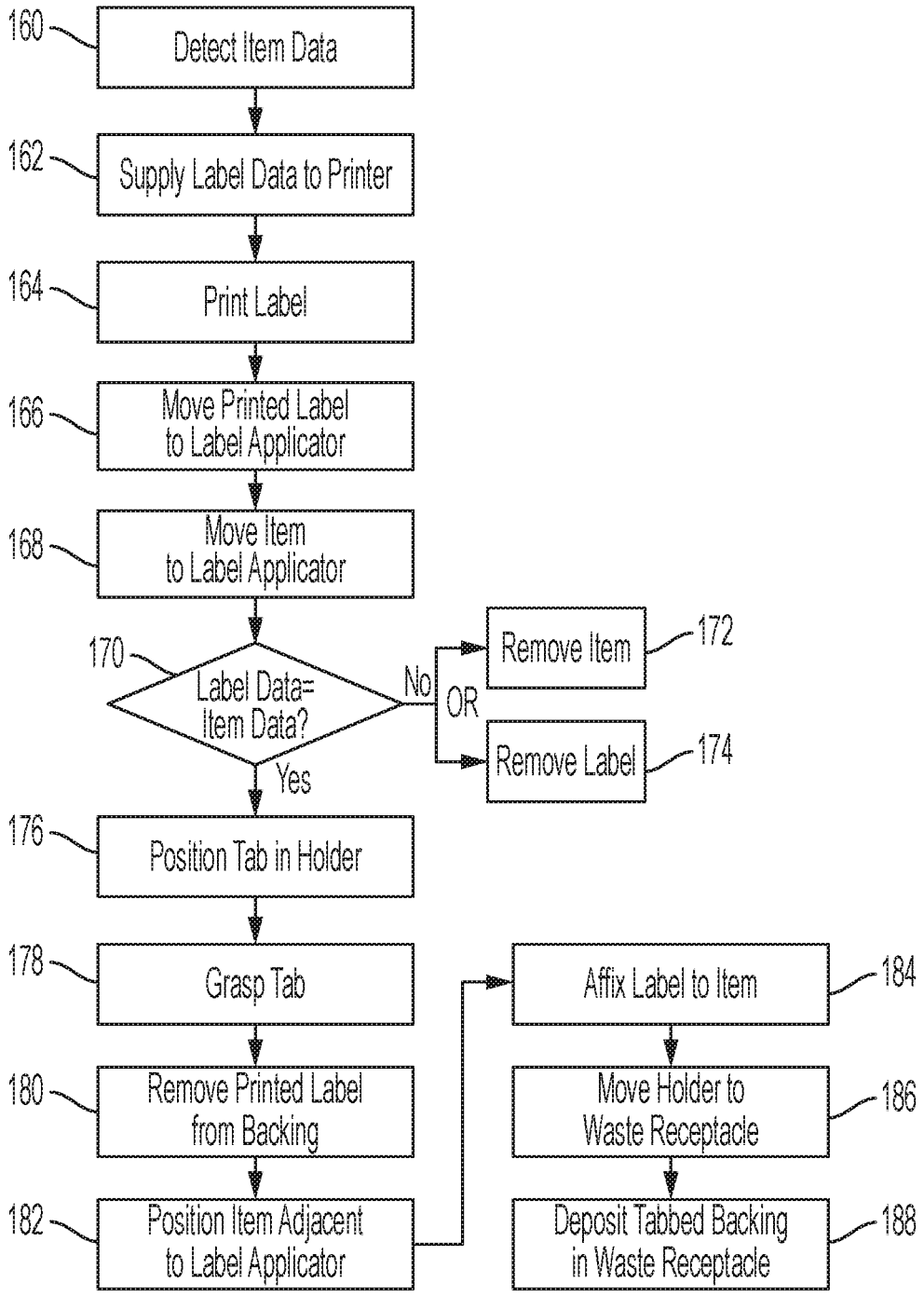
FIG. 9 is a flowchart illustrating operations herein.

FIGS. 7-8 illustrate some operations of the foregoing systems, grouped as "system" 100. For example, FIG. 7 shows the label applicator 130 affixing a printed label 102B on one of the items 120 as the item 120 is moved by the item feeder 114. In contrast, FIG. 8 illustrates a sorter 132 that moves (sorts or directs) one of the items 120 that is not to receive a printed label 102B to the third feeder 116. FIG. 8 also illustrates the label applicator 130 removing one of the printed labels 102B on the tabbed backing 102A, 102C from the label feeder 112.

As shown in FIGS. 7 and 8, the item detector 106 constantly detects the item data of each item 120 as the item(s) 120 pass the item detector 106 on the item feeder 110, and before the item 120 reaches the label applicator 130. The item data may include all information necessary to print the printed label 102B (label data) or the label data can be supplied from another source (e.g., server, local computer, etc.) different from the item detector 106. The processor 216 supplies this label data (from the item detector 106 or another source) to the printer 204, and the printer 204 prints the label data on the frontside of the self-adhesive label 102B that has the tabbed backing 102A, 102C.

Also, as shown in FIGS. 7 and 8, the label feeder 112 moves the printed label(s) 102B on the tabbed backing 102A, 102C from the printer to the label applicator 130 while the item feeder(s) 110, 114 simultaneously move the item 120 to the label applicator 130. A label scanner 134 can optically scan the frontside of the printed label 102B to determine whether the printed label 102B was printed correctly. If the printed label 102B did not print correctly, the movable element 130 moves the defectively printed label to the waste receptacle 136. For example, the moveable element 130 can move and release an incorrect printed label 102B on tabbed backing 102A, 102C directly in the waste receptacle 136; or the moveable element 130 can place the incorrect printed label 102B on tabbed backing 102A, 102C in the holder 128 (see FIG. 5), without removing the incorrect printed label 102B from tabbed backing 102A, 102C, and allow the holder 128 to deposit the entire incorrect printed label 102B on tabbed backing 102A, 102C into the waste receptacle 136.

The processor 216 can compare the label data with the item data from the item detector 106 to determine if a printed label 102B corresponds to an item 120 to which the printed label 102B is to be attached. After performing such a comparison, these systems can: remove (using the sorter 132 that is controlled by the controller) the item 120 from the item feeder(s) 110, 114 before the item 120 reaches the label applicator 130, based on the printed label 102B not corresponding to the item 120; or remove (using the label applicator 130) the printed label 102B from the label feeder 112 before the printed label 102B reaches the label applicator 130, based on the printed label 102B not corresponding to the item 120.

For example, if multiple items 120 are processed sequentially, the processor 216 calculates which printed label 102B of multiple printed labels 102B will be attached to a given item 120 based on the order of each on the feeders, allowing the sorter 132 to remove any items 120 from the item feeder 114 that do not correspond to any of the printed labels 102B on the label feeder 112 according to the order of each on the feeders. Similarly, the movable element 130 can remove any printed labels 102B that do not correspond to any of the items 120 on the item feeder(s) 110, 114.

If a given item 120 and printed label 102B that correspond to one another are removed, the label applicator 130 affixed the backside of the printed label 102B to/on the item 120. Thus, these systems control the label feeder 112 and the item feeder(s) 110, 114 (under control of the processor 216) to position a corresponding item 120 adjacent the label applicator 130 after the movable element has removed a corresponding printed label 102B from the tabbed backing 102A, 102C. Further, such systems move (using the holder transport 124 that is connected to the holder 128, see FIG. 5) a component of the label applicator 130 to a waste receptacle after the moveable element 130 has removed the printed label 102B from the tabbed backing 102A, 102C. This allows the label applicator 130 to deposit the tabbed backing 102A, 102C in the waste receptacle 136.

Figure 10:
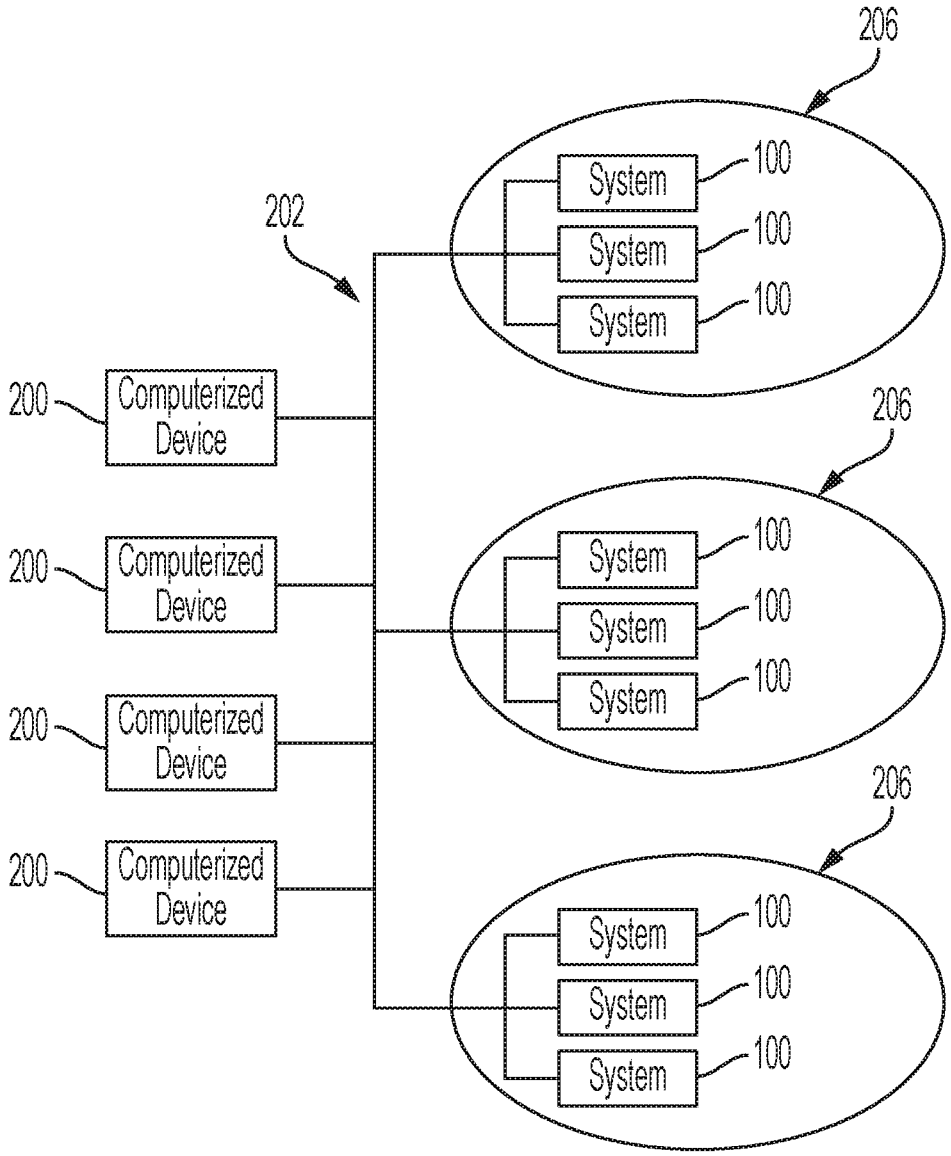
FIG. 10 is a schematic diagram illustrating systems herein.

FIG. 10 is a flowchart illustrating aspects of processing operations and methods herein. As shown in item 160, exemplary methods herein automatically detect item data of the item, before the item reaches the label applicator, using the item detector that is connected to the processor. In item 162, such methods automatically supply (by the processor) the label data of the item data to the printer. In item 164 methods herein automatically print (using the printer) the label data on the frontside of the self-adhesive label that has the tabbed backing, to produce the printed label on the tabbed backing.

Also, in item 166, such methods automatically move (using the label feeder) the printed label on the tabbed backing from the printer to the label applicator and automatically move (using the item feeder) the item to the label applicator in item 168.

In item 170, such methods can automatically compare (using the processor) the label data with the item data to determine if the printed label corresponds to the item. After performing such a comparison, these methods can: automatically remove (using the sorter that is controlled by the controller) the item from the item feeder before the item reaches the label applicator, based on the printed label not corresponding to the item (item 172); or automatically remove (using the label applicator 130) the printed label from the label feeder before the printed label reaches the label applicator, based on the printed label not corresponding to the item (item 174).

If neither the item nor the printed label are removed in items 170-174, these methods automatically position (using the label applicator) the tab within the holder in item 176. Also, in item 178, these methods automatically grasp (using the holder of the label applicator) the tab of the tabbed to backing. Further, in item 180, such methods automatically remove (using the movable element of the label applicator) the printed label from the tabbed backing.

In item 182, these methods automatically control the label feeder and the item feeder to position the item adjacent the label applicator after the movable element has removed the printed label from the tabbed backing. This allows methods herein to, in item 184, automatically affix (using the movable element) the printed label to the item.

Further, in item 186, such methods automatically move (using the holder transport that is connected to the holder) the holder to a waste receptacle after the moveable element has removed the printed label from the tabbed backing. This allows these methods to automatically deposit (using the holder) the tabbed backing in the waste receptacle in item 188.

As shown in FIG. 10, exemplary systems and methods herein include various computerized devices 200 and systems 100 located at various different physical locations 206. The computerized devices 200 can include print servers, printing devices, personal computers, etc., and are in communication (operatively connected to one another) by way of a local or wide area (wired or wireless) network 202.

Figure 11:
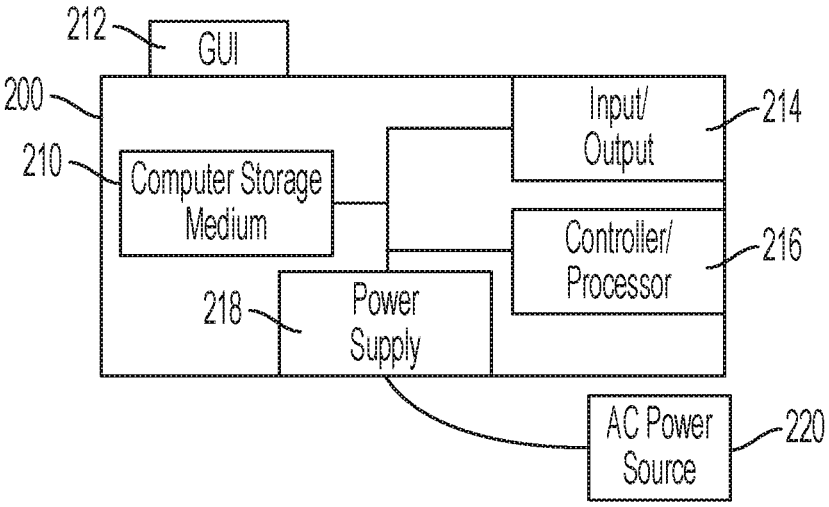
FIGS. 11-12 are schematic diagrams illustrating devices included in systems herein.

FIG. 11 illustrates a computerized device 200, which can be used with systems and methods herein and can comprise, for example, a print server, a personal computer, a portable computing device, etc. The computerized device 200 includes a controller/tangible processor 216 and a communications port (input/output) 214 operatively connected to the tangible processor 216 and to the computerized network 202 external to the computerized device 200. Also, the computerized device 200 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the computerized device 200 and comprises a wired device or wireless device (of any form, whether currently known or developed in the future). The tangible processor 216 controls the various actions of the computerized device. A non-transitory, tangible, computer storage medium device 210 (which can be optical, magnetic, capacitor based, etc., and is different from a transitory signal) is readable by the tangible processor 216 and stores instructions that the tangible processor 216 executes to allow the computerized device to perform its various functions, such as those described herein. Thus, as shown in FIG. 11, a body housing has one or more functional components that operate on power supplied from an alternating current (AC) source 220 by the power supply 218. The power supply 218 can comprise a common power conversion unit, power storage element (e.g., a battery, etc.), etc.

Figure 12:
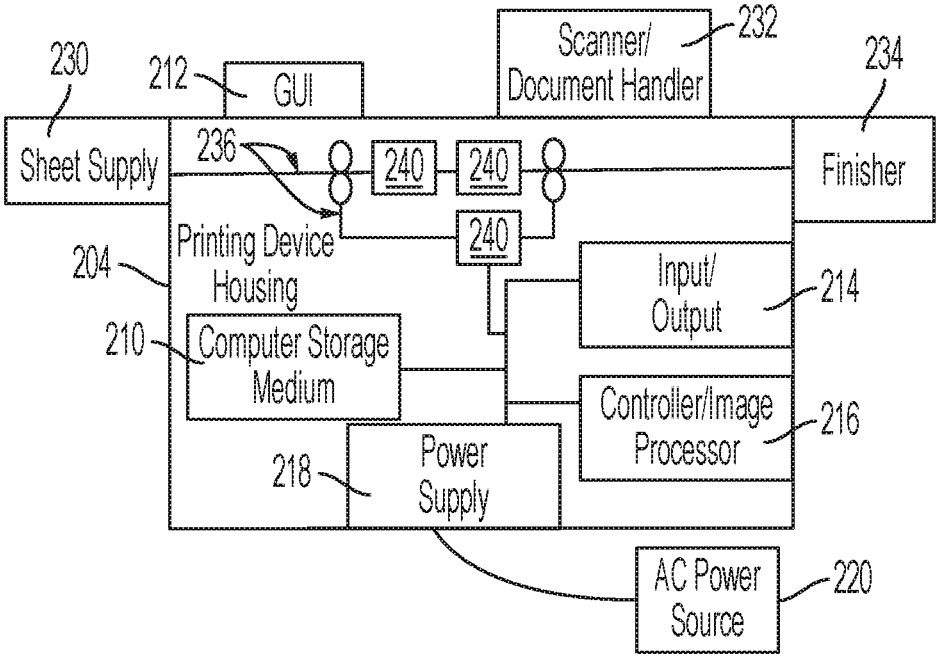

FIG. 12 illustrates a computerized device that is a printing device 204, which can be used with systems and methods herein and can comprise, for example, a printer, copier, multi-function machine, multi-function device (MFD), etc. The printing device 204 includes many of the components mentioned above and at least one marking device (printing engine(s)) 240 operatively connected to a specialized image processor 216 (that is different from a general purpose computer because it is specialized for processing image data), a media path 236 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies a marking material (toner, inks, etc.) to continuous media or sheets of media, whether currently known or developed in the future and can include, for example, devices that use a photoreceptor belt or an intermediate transfer belt, or devices that print directly to print media (e.g., inkjet printers, ribbon-based contact printers, etc.).

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. Additionally, terms such as "adapted to" or "configured to" mean that a device is specifically designed to have specialized internal or external components that automatically perform a specific operation or function at a specific point in the processing described herein, where such specialized components are physically shaped and positioned to perform the specified operation/function at the processing point indicated herein (potentially without any operator input or action). In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A label applicator comprising:

a moveable element positioned to remove a printed label on tabbed backing from a feeder; and a holder comprising grasping elements shaped to grasp a tab of the tabbed backing between the grasping elements, wherein the grasping elements are shaped and positioned to come together to clamp and securely lock onto the tab, and to move apart to unclamp and release the tab, wherein the tabbed backing includes a first section, covering an adhesive area of the printed label, wherein the tab extends from the first section, and wherein the moveable element is positioned to remove the printed label from the tabbed backing while the tab is clamped by the holder.

2. The label applicator according to claim 1, wherein the moveable element comprises an articulated member and a contact element connected to the articulated member, and wherein the contact element is configured to grasp the printed label.

3. The label applicator according to claim 2, wherein the contact element includes a grasping device that grasps the printed label, and wherein the grasping device has a size approximately equal to a size of the printed label.

4. The label applicator according to claim 1, wherein the moveable element is configured to move the printed label on the tabbed backing from the feeder to the holder to allow the holder to grasp the tab, and wherein the moveable element is configured to move the printed label away from the tabbed backing while the tab is grasped by the holder to remove the printed label from the tabbed backing.

5. The label applicator according to claim 1, wherein the tab extends beyond an edge of the printed label in a direction perpendicular to the edge of the printed label.

6. The label applicator according to claim 1, further comprising a holder transport connected to the holder, wherein the holder transport is configured to move the holder to a waste receptacle after the moveable element has removed the printed label from the tabbed backing, and wherein the holder is configured to deposit the tabbed backing in the waste receptacle.

7. The label applicator according to claim 1, wherein the moveable element is configured to affix the adhesive area of the printed label to an item after removing the printed label from the tabbed backing.

8. A system comprising:

a printer configured to print label data on a self-adhesive label, having a tabbed backing, to produce a printed label on the tabbed backing;

a feeder positioned to transport the printed label on the tabbed backing away from the printer; and a label applicator positioned to remove the printed label on the tabbed backing from the feeder, wherein the tabbed backing includes a first section, covering an adhesive area of the printed label, and a tab extending from the first section, wherein the label applicator includes a holder comprising grasping elements shaped to grasp the tab between the grasping elements, wherein the grasping elements are shaped and positioned to come together to clamp and securely lock onto the tab, and to move apart to unclamp and release the tab, and wherein the label applicator includes a moveable element configured to remove the printed label from the tabbed backing.

9. The system according to claim 8, wherein the moveable element comprises an articulated member and a contact element connected to the articulated member, and wherein the contact element is configured to grasp the printed label.

10. The system according to claim 9, wherein the contact element includes a grasping device that grasps the printed label, and wherein the grasping device has a size approximately equal to a size of the printed label.

11. The system according to claim 8, wherein the moveable element is configured to move the printed label on the tabbed backing from the feeder to the holder to allow the holder to grasp the tab, and wherein the moveable element is configured to move the printed label away from the tabbed backing while the tab is grasped by the holder to remove the printed label from the tabbed backing.

12. The system according to claim 8, wherein the tab extends beyond an edge of the printed label in a direction perpendicular to the edge of the printed label.

13. The system according to claim 8, further comprising a holder transport connected to the holder, wherein the holder transport is configured to move the holder to a waste receptacle after the moveable element has removed the printed label from the tabbed backing, and wherein the holder is configured to deposit the tabbed backing in the waste receptacle.

14. The system according to claim 8, wherein the moveable element is configured to affix the adhesive area of the printed label to an item after removing the printed label from the tabbed backing.

15. A label applicator comprising:

a moveable element positioned to remove a printed label on tabbed backing from a feeder; and a clamp comprising grasping elements shaped to pinch a tab of the tabbed backing between the grasping elements, wherein the grasping elements are shaped and positioned to come together to clamp and securely lock onto the tab, and to move apart to unclamp and release the tab, wherein the tabbed backing includes a first section, covering an adhesive area of the printed label, wherein the tab extends from the first section, and wherein the moveable element is positioned to remove the printed label from the tabbed backing while the tab is clamped by the clamp.

16. The label applicator according to claim 15, wherein the moveable element comprises an articulated member and a contact element connected to the articulated member, and wherein the contact element is configured to grasp the printed label.

17. The label applicator according to claim 16, wherein the contact element includes a grasping device that grasps the printed label, and wherein the grasping device has a size approximately equal to a size of the printed label.

18. The label applicator according to claim 15, wherein the moveable element is configured to move the printed label on the tabbed backing from the feeder to the clamp to allow the clamp to pinch the tab, and wherein the moveable element is configured to move the printed label away from the tabbed backing while the tab is pinched by the clamp to remove the printed label from the tabbed backing.

19. The label applicator according to claim 15, wherein the tab extends beyond an edge of the printed label in a direction perpendicular to the edge of the printed label.

20. The label applicator according to claim 15, further comprising a holder transport connected to the clamp, wherein the holder transport is configured to move the clamp to a waste receptacle after the moveable element has removed the printed label from the tabbed backing, and wherein the clamp is configured to deposit the tabbed backing in the waste receptacle.

* * * * *